US012110750B2

(12) United States Patent
Wai et al.

(10) Patent No.: US 12,110,750 B2
(45) Date of Patent: Oct. 8, 2024

(54) DOWNHOLE HIGH EXPANSION ANCHOR SYSTEM

(71) Applicant: Halliburton Energy Services, Inc., Houston, TX (US)

(72) Inventors: Simon Whye Kwong Wai, Singpore (SG); Wei Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 18/096,196

(22) Filed: Jan. 12, 2023

(65) Prior Publication Data

US 2024/0240533 A1 Jul. 18, 2024

(51) Int. Cl.
*E21B 23/01* (2006.01)
*E21B 47/09* (2012.01)

(52) U.S. Cl.
CPC ..... *E21B 23/01* (2013.01); *E21B 47/09* (2013.01)

(58) Field of Classification Search
CPC ..... E21B 23/01; E21B 47/09
See application file for complete search history.

(56) References Cited

U.S. PATENT DOCUMENTS

| | | | | |
|---|---|---|---|---|
| 6,920,936 | B2 | 7/2005 | Sheiretov et al. | |
| 9,441,433 | B2 | 7/2016 | Andersen et al. | |
| 11,248,427 | B2 | 2/2022 | Mauchien et al. | |
| 2009/0056938 | A1 * | 3/2009 | Treviranus | E21B 7/20 166/255.2 |
| 2013/0068479 | A1 | 3/2013 | AlDossary | |
| 2018/0003850 | A1 | 1/2018 | Jaaskelainen et al. | |
| 2018/0196005 | A1 * | 7/2018 | Fanini | E21B 47/007 |
| 2020/0040679 | A1 * | 2/2020 | Mauchien | E21B 23/01 |
| 2020/0332615 | A1 * | 10/2020 | Wiesenborn | E21B 31/1135 |

FOREIGN PATENT DOCUMENTS

EP 2205818 B1 12/2012

OTHER PUBLICATIONS

Foreign Communication from Related Application—International Search Report and Written Opinion of the International Searching Authority, International Application No. PCT/US2023/010742 dated Oct. 4, 2023, 13 pages.
Filing Receipt, Specification and Drawings for U.S. Appl. No. 18/190,197, entitled "Improved Downhole Anchor System," filed Mar. 27, 2023, 30 pages.

* cited by examiner

*Primary Examiner* — Giovanna Wright
*Assistant Examiner* — Ronald R Runyan
(74) *Attorney, Agent, or Firm* — Conley Rose, P.C.; Rodney B. Carroll

(57) ABSTRACT

A downhole anchoring mechanism configured to anchor a downhole tool assembly to a target location within an oilfield tubular. The anchoring mechanism comprises an anchor pad, a first arm coupled to a first hub and the anchor pad, and an extension mechanism coupled to a wedge hub and the anchor pad. The anchor pad is configured to extend radially outwards by the tapered surface of the wedge hub to engage an inner surface of a small oilfield tubular in response to the extension mechanism being configured in a deactivated mode. The anchor pad is configured to be extended radially outwards by the first arm and the extension mechanism to engage the inner surface of a large oilfield tubular in response to the extension mechanism being configured in an activated mode. The extension mechanism is a telescopic arm assembly or a sliding axle assembly.

25 Claims, 5 Drawing Sheets

DOWNHOLE HIGH EXPANSION ANCHOR SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbore servicing operations typically utilize a first type of downhole tool for small tubulars and a second type for large tubulars as the downhole tool needs to be anchored to the wellbore tubular during the servicing operation. The downhole tool is typically conveyed into the wellbore through a small wellbore tubular, for example, production tubing. In some scenarios, the downhole tool can anchor to the small wellbore tubular to perform a servicing operation within the wellbore. The downhole tool typically utilizes a first type of anchoring system with wedges to extend a set of slips to grip the small wellbore tubing. The first type of anchoring system for the downhole tool can have limited reach and may not be suitable for large wellbore tubing.

In other scenarios, the downhole tool can exit the small wellbore tubular to anchor inside of a large wellbore tubular, for example, a casing string. The downhole tool typically uses a second type of anchoring system, referred to as a high expansion anchoring system, to extend an anchoring pad out to grip the large wellbore tubing. The high expansion anchoring system of the downhole tool may not generate the gripping force to anchor the downhole tool in small wellbore tubing. A downhole tool with an anchoring system that can anchor in small wellbore tubulars and large wellbore tubulars is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Once an oil or gas well is drilled, a downhole tool can be conveyed into the wellbore via a logging cable to perform wellbore operations such as logging or perforating operations. To conduct these wellbore operations, the downhole tool may need to be centralized, e.g., positioned along the central axis of an oilfield tubular. The centralization of the downhole tool can be accomplished with an anchoring mechanism, e.g., linkages equally spaced around the outside of the downhole tool that extends radially to anchor or grip onto an inner surface of the oilfield tubular.

The anchoring mechanism for the downhole tools can generate an anchoring force to ensure proper wellbore operation. The anchoring mechanism can comprise a set of anchor pads to generate a radial force with a friction component against the inner surface of the oilfield tubular to prevent sliding or movement between the anchor pad and the inner surface of the tubular. The anchoring mechanism can comprise an uphole arm, an anchor pad, and a downhole arm to extended to large diameter oilfield tubular, e.g., casing. In another scenario, the anchoring mechanism can comprise a set of slips and wedge to extend to small diameter tubulars, e.g., production tubing.

To address some of the challenges described above, as well as others, apparatus, systems, and methods for anchoring a downhole tool in large diameter and small diameter oilfield tubulars with a singular anchoring mechanism are described. Various embodiments include an anchoring mechanism configured to be extended by at least one wedge. This anchoring mechanism can anchor the downhole tool to a small diameter tubular. Various embodiments comprise an anchoring mechanism with an extension mechanism to extend the past the outer surface of the wedge to anchor the downhole tool within a large diameter tubular. Various example embodiments that can provide some or all of these advantages will now be described in detail.

Figure 1A:
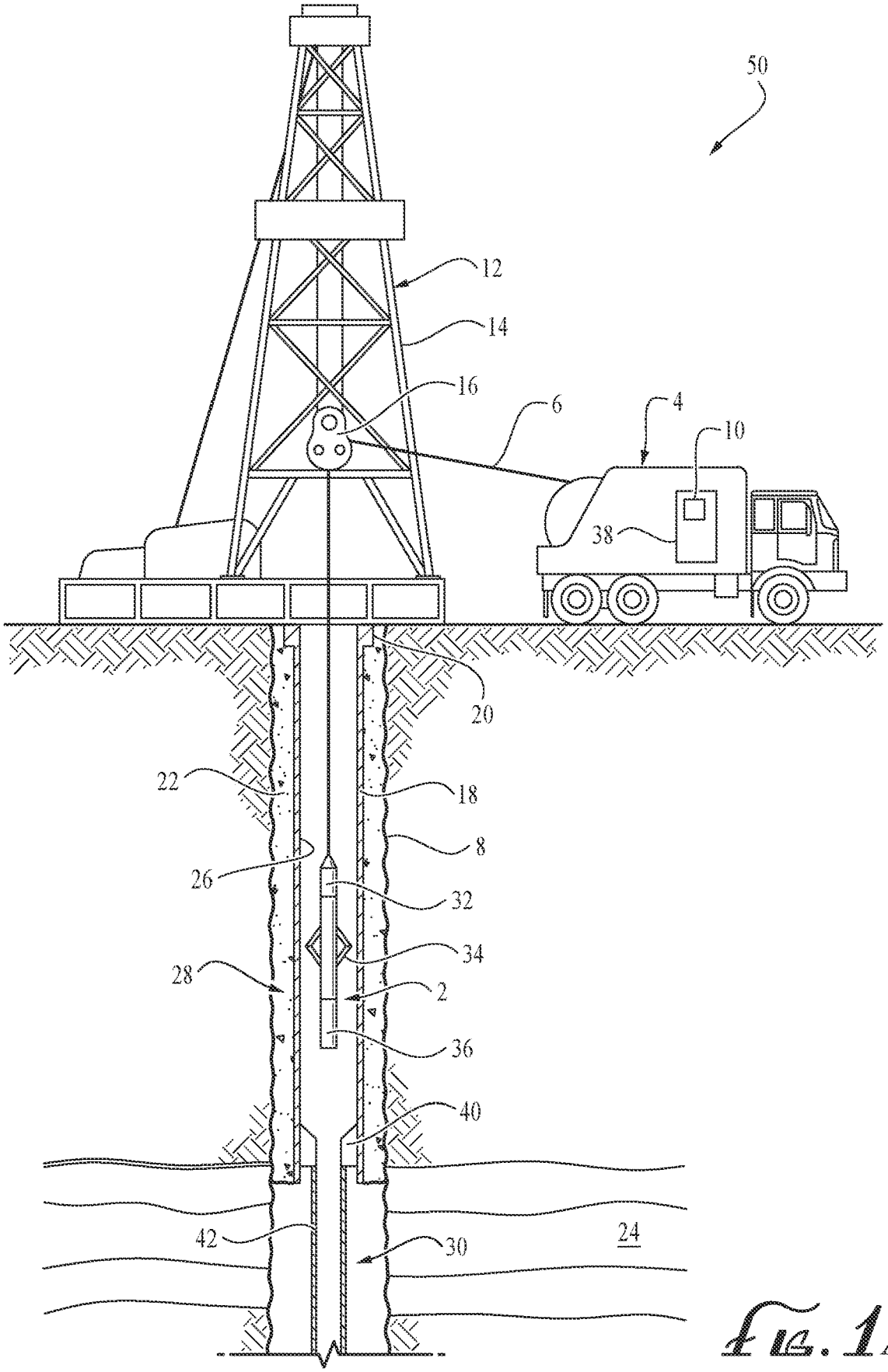
FIG. 1A is an illustration of a wireline operating environment at a wellsite according to an embodiment of the disclosure.
Figure 1B:
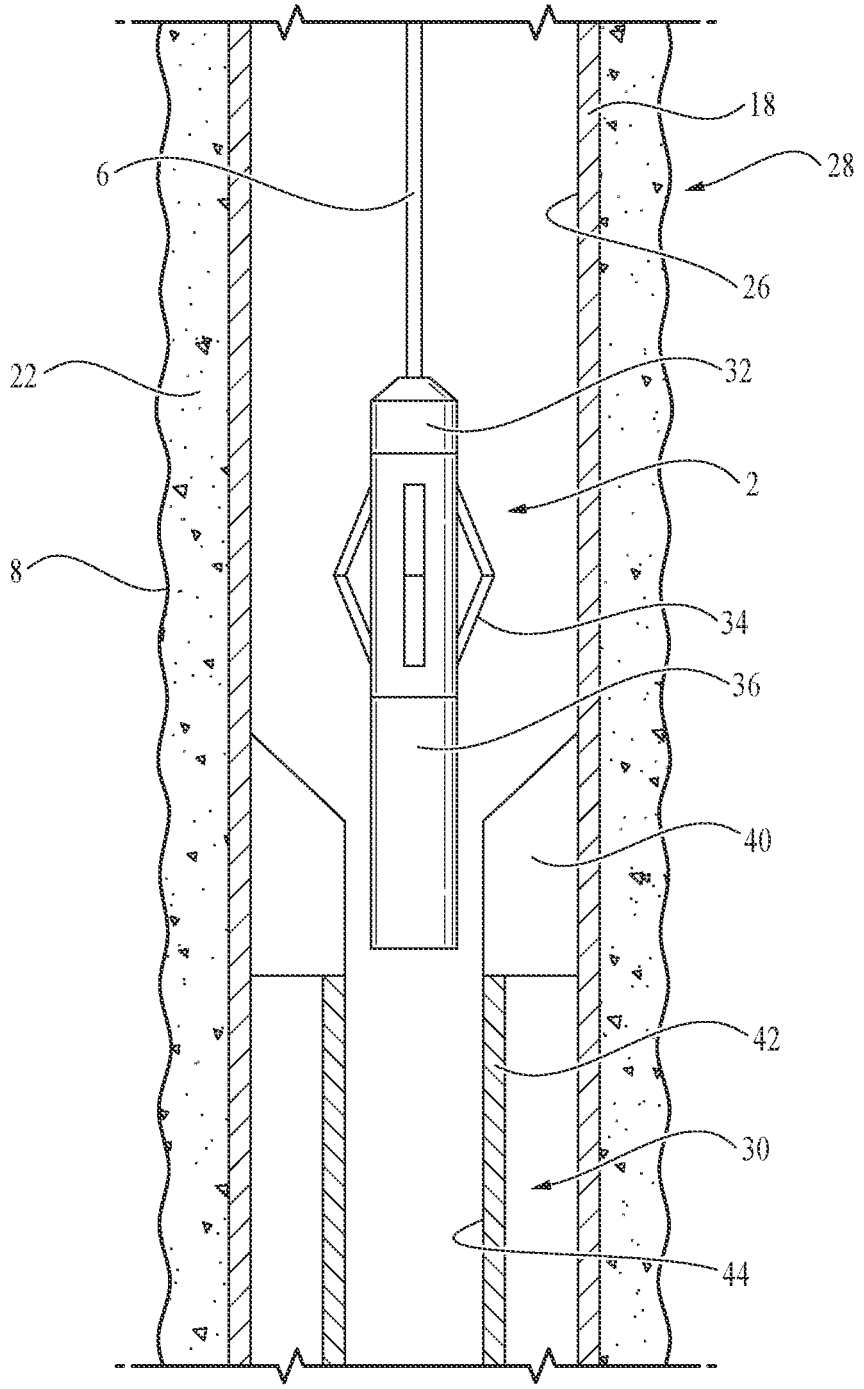
FIG. 1B is an illustration of a wellbore of the wireline operating environment according to an embodiment of the disclosure.

Turning now to FIGS. 1A and 1B, a wellbore servicing environment 50 is described. In an embodiment, a wireline servicing operation can comprise a downhole tool assembly 2 communicatively coupled to a surface logging facility 4 by a workstring 6, for example, wireline or logging cable. In an example, a downhole tool assembly 2 can be a perforating gun assembly with an anchoring mechanism conveyed into a wellbore 8 to perforate a target location, e.g., a formation 24.

The wireline servicing operation can begin with transporting the surface logging facility 4, the downhole tool assembly 2, and various wireline equipment to a remote wellsite. The remote wellsite can on land (as illustrated in FIG. 1A) or offshore. The remote wellsite can include various types of drilling rigs, workover rigs, wellheads, production equipment, production platforms, jack-up rigs, offshore rigs supported by floating structures, a drillship, or any similar operating environment.

The wireline servicing operation can be performed with a drilling or workover rig 12 comprising a derrick 14 and various wireline equipment 16 for the conveyance of the downhole tool assembly 2 into the wellbore 8. The wellbore 8 may include one or more casing string 18, e.g., pipes threadingly coupled together, and anchored at surface with a wellhead 20. The casing string 18 can be cemented 22 within the wellbore 8. For example, the wellbore 8 can comprise a casing string 18 supported by cement 22 extending into a formation 24. In some embodiments, the wellbore 8 can comprise a portion of the wellbore 8 without a casing string 18.

The wireline servicing operation comprises lowering the downhole tool assembly 2 to a target depth, e.g., the formation 24, anchoring the downhole tool assembly 2 with an anchoring device 34, and activating a service tool 36. The downhole tool assembly 2 comprises a wireline logging head 32 to electrically couple the anchoring device 34 and the service tool 36 to the logging facility 4. The service tool 36 of the downhole tool assembly 2 can be a shifting tool, a perforating gun assembly, a packer assembly, a frac plug assembly, an isolation device, or any other downhole servicing tool. For example, the downhole tool assembly 2 can be lowered into the wellbore 8 to a target depth, e.g., the formation 24, anchored to the casing string 18 via the anchoring device 34, and the service tool 36 can be activated, for example, the perforating gun assembly fired to perforate the casing string 18. The anchoring device 34 within the downhole tool assembly 2 can be actuated from the surface logging facility 4, also referred to as a logging facility, via a processor within the wireline logging head 32. The wireline logging head may include one or more processors, memory, and a data acquisition process executing in memory to control the function of the anchoring device 34 and record periodic datasets indicative of the servicing operation. The periodic datasets can comprise measurement data from one or more sensors, such as accelerometers, and may be stored in memory or transmitted to surface via the logging cable 6. The measurement data can be communicated to the logging facility 4 for storage, processing, and analysis. The logging facility 4 may be provided with electronic equipment 38 and a controller 10, e.g., computer system comprising a processor and non-transitory memory, for various types of signal processing. In some embodiments, the wireline logging head 32 may not include a processor and the logging facility 4 may control the anchoring device 34 via the controller 10.

Turning now to FIG. 1B, in some embodiments, the downhole tool assembly 2 can be conveyed into a wellbore 8 through a small oilfield tubular, e.g., a production tubing, to a target depth. The target depth for the wellbore servicing operation can be located within the production tubing. The anchoring device 34 of the downhole tool assembly 2 can be activated to anchor the downhole tool assembly 2 within the production tubing at the target depth. The service tool 36 of the downhole tool assembly 2 can be activated to perform the wellbore operation or a portion of the wellbore operation.

In some embodiments, the downhole tool assembly 2 can be conveyed through the production tubing, e.g., small oilfield tubular, to a target location within a large oilfield tubular below the exit of the production tubing, e.g., within a casing string location 28. The anchoring device 34 of the downhole tool assembly 2 can be activated to anchor the downhole tool assembly 2 to the inner surface 26 of the casing string 18, e.g., large oilfield tubular, at the target depth. The service tool 36 of the downhole tool assembly 2 can be activated to perform the wellbore operation or a portion of the wellbore operation within the casing string 18.

In some embodiments, the downhole tool assembly 2 can be conveyed through the production tubing and the casing string location 28 to a location within a lower completion 30. The lower completion can comprise a hanger 40 and a completion string 42. The hanger 40 can be a liner hanger, a production packer, a gravel pack packer, a cementing equipment, or any downhole assembly configured to anchor a smaller tubular to a larger tubular. The completion string 42 can comprise a small diameter oilfield tubular (e.g., production tubing, liner, casing, or workover tubing) and/or completion equipment such as a housing, an extension, a sand screen, a completion valve, an ESP pump assembly, an isolation device, or any combination thereof. The downhole tool assembly 2 can be conveyed into the lower completion 30 via the workstring 6 to a target location within the completion string 42. The anchoring device 34 of the downhole tool assembly 2 can be activated to anchor the downhole tool assembly 2 to the inner surface 44 of the completion string 42, e.g., small oilfield tubular, at the target depth. The service tool 36 of the downhole tool assembly 2 can be activated to perform the wellbore operation or a portion of the wellbore operation within the completion string 42.

Figure 2A:
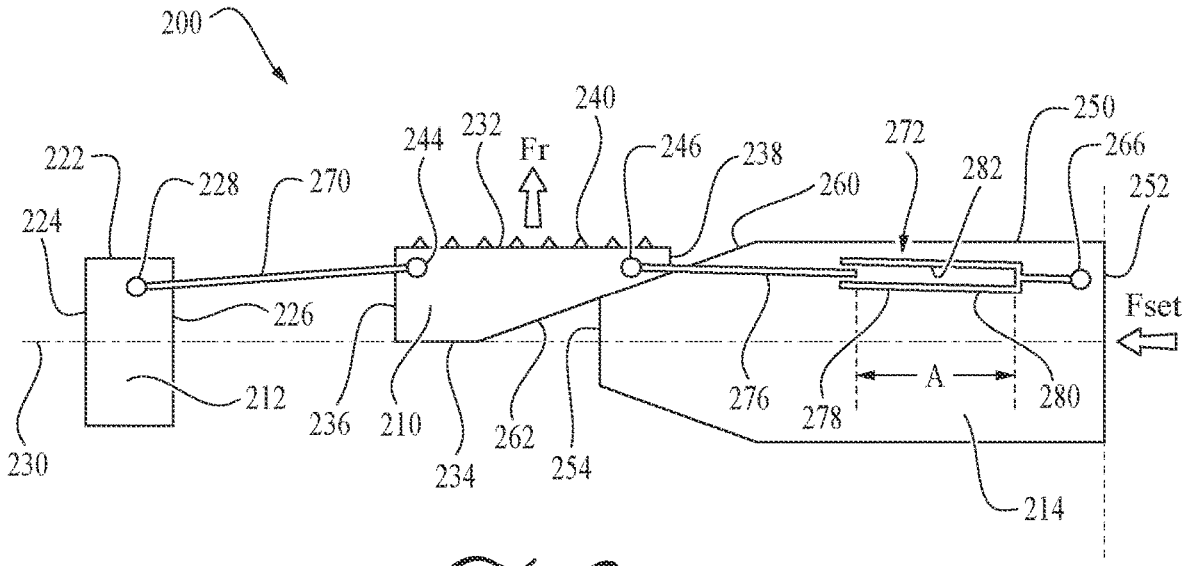
FIG. 2A is a side view of an anchoring mechanism of a downhole tool assembly according to an embodiment of the disclosure.

Turning now to FIG. 2A, an embodiment of the anchoring device 34 is illustrated. For example, FIG. 2A illustrates a side view of the anchoring device 34 of the downhole tool assembly 2. In some embodiments, the anchoring device 200 comprises a first hub 212, an anchor pad 210, and a wedge hub 214. The first hub 212 can be a generally ring shape with an outer diameter 222, an outside face 224, an inside face 226, and a first pivot axle 228. The axis of the first hub 212 can be coincident with the longitudinal axis 230, also referred to as the central axis, of the anchoring device 200. The outside face 224 of the first hub 212 can be coupled to one or more parts and/or assemblies that are not illustrated that can fix the location of the first hub 212 relative to the other parts of the anchoring device 34. The anchor pad 210 can comprise a single segment of a generally cylinder shape segmented into multiple individual segments with an outer surface 232, an inner surface 234, a front face 238, and a back face 236. The outer surface 232 can comprise multiple teeth 240 configured to grip or bite the inner surface of an oilfield tubular. The teeth 240 can be sharp protrusions machined from the outer surface 232, button inserts cemented or pressed into the outer surface 232, protrusions welded, protrusion formed with an additive process, or combinations thereof. The anchor pad 210 can comprise a first pivot point 244 and a second pivot point 246. The wedge hub 214 can be a generally cylindrical shape with an outer surface 250, a back face 252, a front face 254, and a tapered outer surface 260. The tapered outer surface 260 can have a frustoconical shape or a planar tapered surface. The tapered outer surface 260 of the wedge hub 214 may correspond and slidably engage with the inner surface 262 of the anchor pad 210. In some embodiments, the tapered outer surface 260 and inner surface 262 can both be a frustoconical shape configured for slidable engagement. In some embodiments, the tapered outer surface 260 and inner surface 262 can both be a planar tapered surface configured for slidable engagement. The wedge hub 214 can include a pivot axle 266. The axis of the wedge hub 214 can be coincident with the central axis 230 of the anchoring device 200. The back face 252 of the wedge hub 214 can be coupled to one or more parts and/or assemblies that are not illustrated.

The anchoring device 200 can include a first arm 270 and an extension mechanism to guide the anchor pad 210 into engagement with an inner surface of a tubular. In some embodiments, the extension mechanism can be a telescopic arm 272. The first arm 270 can be a rigid member rotationally coupled to the first pivot axle 228 of the first hub 212 and the first pivot point 244 of the anchor pad 210. Although the first arm 270 is illustrated as a round rod shape, it is understood that the first arm 270 can have any geometric cross-sectional shape, for example, round, oval, square, rectangular, hexagonal, octagonal, any suitable geometric shape, or combinations thereof. The first arm 270 is configured to transfer an actuation force from the first hub 212 via the first pivot axle 228 to the anchor pad 210 via the first pivot point 244.

In some embodiments, the telescopic arm 272, e.g., the extension mechanism, can comprise an extension arm 276 slidably engaged with a housing 278. The extension arm 276 can be a ridge member with a generally round shape and rotationally coupled to the second pivot point 246 of the anchor pad 210. The housing 278 can be a generally cylinder shape with an outer surface 280, an inner surface 282, and rotationally coupled to the pivot axle 266 of the wedge hub 214. The extension arm 276 can move a linear distance labeled "A" within the housing 278 of the telescopic arm 272. In a first position, also referred to as the run-in position, the linear distance A can be a maximum value and the extension arm 276 is constrained to the interior of the housing 278, e.g., can't exit the housing 278. In some embodiments, the telescopic arm 272 can be placed in tension while in the first position. For example, the telescopic arm 272 can be in tension to retain the anchor pad 210 in a run-in position by pulling the second pivot point 246 with the pivot axle 266 of the wedge hub 214.

Figure 2B:
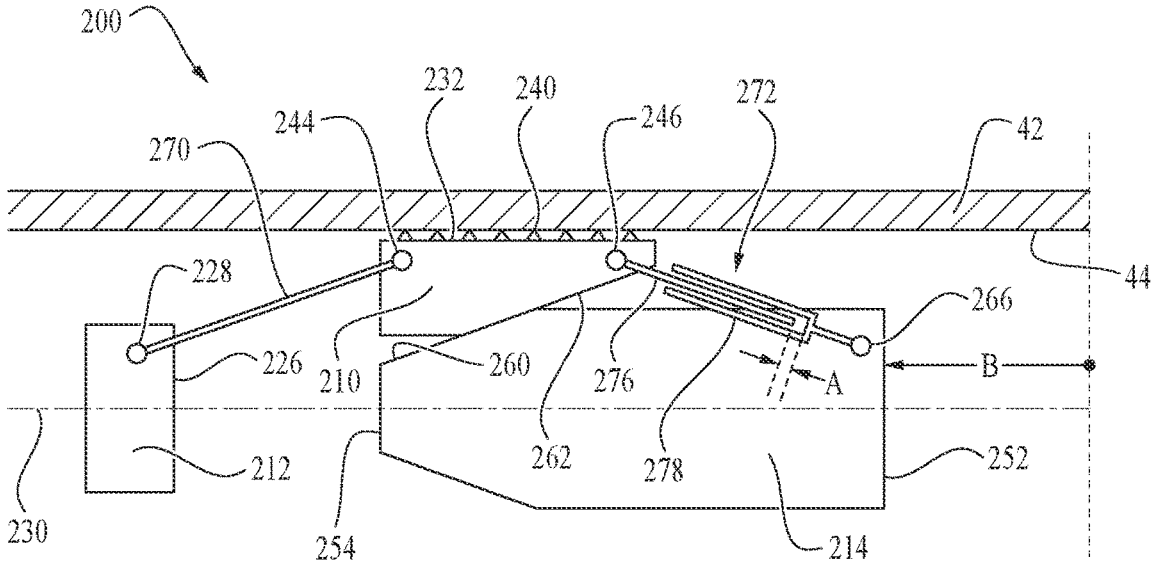
FIG. 2B is a side view of an anchoring mechanism of a downhole tool assembly set in a tubular according to an embodiment of the disclosure.

Turning now to FIG. 2B, the operation of the anchoring device 200 in small oilfield tubulars is described. In some embodiments, the anchoring device 200 of the downhole tool assembly 2 can be set in a small oilfield tubular, for example, a production tubing or a lower completion 30. For example, as previously disclosed, the anchoring device 200 can be set or anchored to the inner surface 44 of a completion string 42. The wedge hub 214 can be urged towards the first hub 212 by an actuation mechanism coupled to the back face 252. For example, force Fset labeled on FIG. 2A can be applied to the back face 252 to urge the wedge hub 214 towards the first hub 212. The anchor pad 210 can extend outwards, e.g., away from the central axis 230, towards the inner surface 44 of the tubular 42 as the inner surface 262 slidingly contacts the tapered outer surface 260 (frustoconical or planar surface) of the wedge hub 214. For example, the anchor pad 210 can exert a force labeled Fr to a surface contacted by the outer surface 232 of the anchor pad 210 in response to the force Fset applied to the back face 252 of the wedge hub 214. The measurement of the linear distance A within the telescopic arm 272 can decrease in value as the inner surface 262 of the anchor pad 210 travels along the tapered outer surface 260 of the wedge hub 214. The outer surface 232 of the anchor pad 210 can grip or anchor to the inner surface 44 of the oilfield tubular. The actuation mechanism can urge the wedge hub 214 towards the first hub 212 a linear distance labeled B until the outer surface 232 of the anchor pad 210 grips the inner surface 44. The linear force of the actuating mechanism can be translated to a radial force exerted by the outer surface 232 of the anchor pad 210 by the tapered outer surface 260 of the wedge hub 214. In some embodiments, the anchoring teeth 240 may contact the inner surface 44 before or in place of the outer surface 232. It is understood that the anchoring teeth 240, the outer surface 232, or combinations thereof contact and grip the inner surface 44 of the oilfield tubular 42.

The extension mechanism can be configured in an activated or a deactivated mode. In the deactivated mode, the linear distance labeled "A" is greater than zero and the anchor pad is radially extended towards the inner surface of the tubular by the tapered outer surface 260 of the wedge hub 214 and the inner surface 262 of the anchor pad 210. In the activated mode, the linear distance labeled "A" is equal to zero the anchor pad is radially extended towards the inner surface of the tubular by the first pivot point 244 and the second pivot point 246. In some embodiments, the extension mechanism can be in compression in the activated mode. For example, an end face of the extension arm 276 can be in direct contact with the housing 278 when the linear distance "A" is equal to zero and thus, additional force places the extension arm 276 in compression.

In some embodiments, the anchor pad 210 grips the inner surface 44 of the tubular 42 with the extension mechanism deactivated and/or with the distance A greater than zero. For example, the outer surface 232 of the anchor pad 210 can grip the inner surface 44 of the tubular 42 when the extension arm 276 is 50% of the distance A within the housing 278. The size of the tubular 42, e.g., distance of the inner surface 44 to the central axis 230, can determine when the outer surface 232 of the anchor pad 210 grips the inner surface 44 and thus, determine the portion of the distance A the extension arm 276 travels within the housing 278. In one scenario, the inner surface 44 can be closer to the central axis 230 and the extension arm 276 can travel 10% of the distance A when the anchor pad 210 grips the tubular 42. In another scenario, the inner surface 44 can be a greater distance from the central axis 230 and the extension arm 276 can travel 90% of the distance A when the anchor pad 210 grips the tubular 42. Although three percentages are described, it is under stood that the extension arm 276 can travel 10%, 20%, 30%, 40%, 50%, 60%, 70%, 80%, 90%, or 100% of the distance A until the anchor pad 210 grips the tubular 42. As illustrated in FIG. 2B, the extension arm 276 has traveled 100% of the distance A (thus, distance A is zero), for the outer surface 232 and/or teeth 240, to grip the inner surface 44 of the tubular 42.

In some embodiments, the actuation feature can urge the wedge hub 214 towards the first hub 212. For example, the actuation feature can urge the front face 254 of the wedge hub 214 towards the back face 226 of the first hub 212. In some embodiments, the actuation feature can comprise a first volume of fluid, a pump, and a second volume of fluid. For example, a mandrel within housing can be urged outward from the housing by transferring fluid from the first volume to the second volume by the pump. In some embodiments, the mandrel within the housing can be extended by an electric motor turning a gearing system mechanically coupled to the mandrel. In some embodiments, the mandrel can be a threaded rod that is extended/retracted from the housing by an electric motor. The actuation feature can be controlled to move in a first direction, e.g., to set the anchor mechanism, and move in a second direction, e.g., to release the anchor mechanism, by the controller. In some embodiments, the controller is electrically coupled to the actuation feature to provide voltage and power to the actuation feature.

Figure 2C:
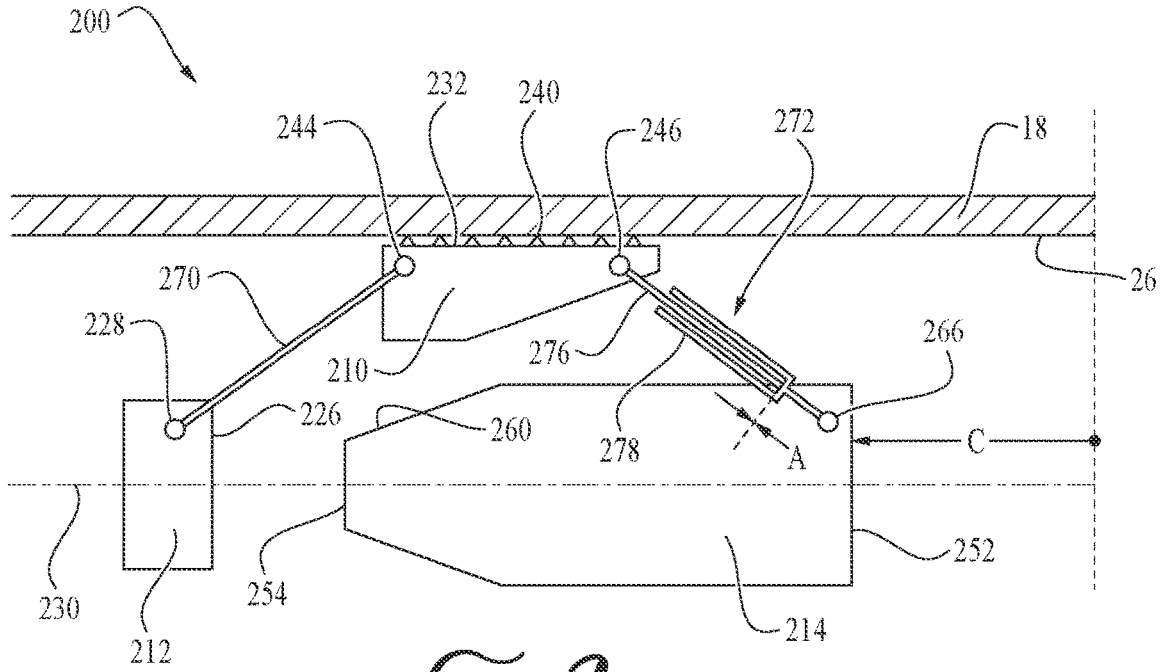
FIG. 2C is a side view of an anchoring mechanism of a downhole tool assembly set in another tubular according to an embodiment of the disclosure.

Turning now to FIG. 2C, the operation of the anchoring device 200 in large oilfield tubulars is described. In some embodiments, the anchoring device 200 of the downhole tool assembly 2 can be set in a large oilfield tubulars, for example, the casing string 18 shown in FIG. 1B. For example, as previously disclosed the anchoring device 200 can be set or anchored to the inner surface 26 of the casing string 18. The wedge hub 214 can be urged towards the first hub 212 by the actuation mechanism as the anchor pads 210 extend outwards, e.g., away from the central axis 230. The inner surface 262 of the anchor pads 210 can slidingly engage the planar surface 260 of the wedge hub 214 until the extension mechanism activates, e.g., the linear distance A is zero. When the telescopic arm 272 closes, e.g., the extension arm 276 contacts the housing 278 and the linear distance A is zero, the telescopic arm 272 can lift the anchor pad 210 towards the inner surface 26 of the oilfield tubular 18 and away from the central axis 230. The actuation mechanism can urge the wedge hub 214 a linear distance labeled C with the extension feature in the activated mode to extend the anchor pad 210 radially outwards until the outer surface 232 of the anchor pad 210 grips the inner surface 26 of the oilfield tubular 18. The linear force of the actuating mechanism can be translated to a radial force exerted by the outer surface 232 of the anchor pad 210 by the first arm 270 rotationally coupled to the first hub 212 and the telescopic arm 272 rotationally coupled to the wedge hub 214.

Although the anchoring device 200 is illustrated as a single set of an anchor pad 210, a first arm 270, and a telescopic arm 272, it is understood that the anchoring device 200 can have 2 sets at 180 degrees, 3 sets at 120 degrees, 4 sets at 90 degrees, or any number of sets.

Figure 3A:
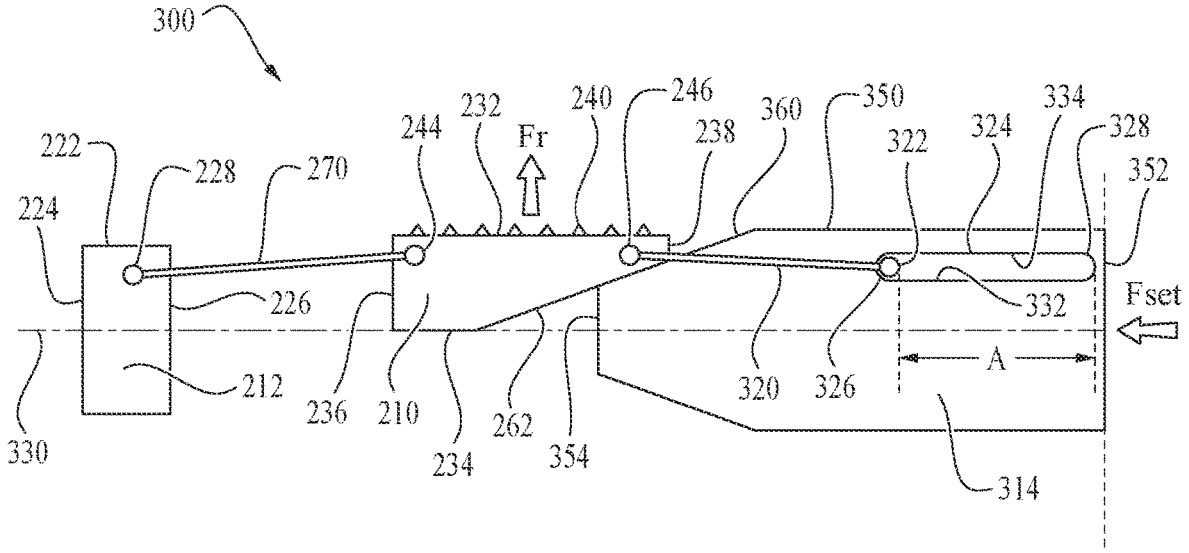
FIG. 3A is a side view of an anchoring mechanism of a downhole tool assembly according to another embodiment of the disclosure.

Turning now to FIG. 3A, an embodiment of the anchoring device 34 is illustrated. For example, FIG. 3A illustrates a side view of the anchoring device 300 of the downhole tool assembly 2. Anchoring device 300 can share parts and features with anchoring device 200 and thus share the same reference number. In some embodiments, the anchoring device 300 comprises a first hub 212, an anchor pad 210, and a wedge hub 314. As previously described, the first hub 212 can be a generally ring shape with an inside face 226, a first pivot axle 228, an axis that can be coincident with the longitudinal axis 330 of the anchoring device 200, and an outside face 224 of the first hub 212 can fix the axial and linear location of the first hub 212 relative to the other parts of the anchoring device 34. The anchor pad 210 can comprise an outer surface 232 and/or a plurality of teeth 240, a first pivot point 244, and a second pivot point 246. The outer surface 232 and/or the plurality of teeth 240 can be configured to grip or bite the inner surface of an oilfield tubular.

In some embodiments, the wedge hub 314 can be a generally cylindrical shape with an outer surface 350, a back face 352, a front face 354, and a tapered outer surface 360. The tapered outer surface 360 can have a frustoconical shape or a planar tapered surface. The tapered outer surface 360 of the wedge hub 314 may correspond and slidably engage with the inner surface 262 of the anchor pad 210. In some embodiments, the tapered outer surface 360 and inner surface 262 can both be a frustoconical shape configured for slidable engagement. In some embodiments, the tapered outer surface 360 and inner surface 262 can both be a planar tapered surface configured for slidable engagement.

The anchoring device can include a first arm 270 and an extension mechanism to guide the anchor pad 210 into engagement with an inner surface of a tubular. In some embodiments, the extension mechanism can comprise a sliding axle assembly 366 include a pivot axle 322 within an axle slot 324 located within the wedge hub 314. The axle slot 324 comprises a first end 326, an upper side 334, a lower side 332, and a second end 328. The pivot axle 322 can be configured to move from a linear distance labeled "A" from an initial position abutting the first end face 326 to a second position abutting the second end face 328. The axis of the wedge hub 314 can be coincident with the longitudinal axis 330 of the anchoring device 300. The back face 352 of the wedge hub 314 can be coupled to one or more parts and/or assemblies that are not illustrated. The sliding axle assembly 366, e.g., the extension mechanism, can be in a deactivated mode when the linear distance "A" is greater than zero and in an activated mode when the sliding axle assembly 366 is in a compressive state due to the linear distance "A" being zero.

In some embodiments, the anchoring device 300 can include a first arm 270 and a second arm 320 to guide the anchor pad 210 into engagement with an inner surface of a tubular. As previously described, the first arm 270 can be a rigid member rotationally coupled to the first pivot axle 228 of the first hub 212 and the first pivot point 244 of the anchor pad 210. The first arm 270 is configured to transfer an actuation force from the first hub 212 via the first pivot axle 228 to the anchor pad 210 via the first pivot point 244.

In some embodiments, the second arm 320 can be a rigid member rotationally coupled to a second pivot point 246 and the pivot axle 322. The second arm 320 can be a generally round cross-section shape or any other geometric cross-section. The second arm 320, coupled to the pivot axle 322, can move a linear distance labeled "A" within the axle slot 324 of the wedge hub 314. In a first position, also referred to as the run-in position, the linear distance A can be a maximum value and the second arm 320 can be placed in tension with the translating axle 322 abutting the first end 326. For example, the second arm 320 can be in tension to retain the anchor pad 210 in a run-in position with the axle 322 abutting the first end 326 while a tension force is placed on the wedge hub 314 via the back face 352. The sliding axle assembly 366, e.g., the extension mechanism, can have an activation mode and a deactivation mode. The sliding axle assembly 366 can be in the deactivation mode in response to being placed in the run-in position or the value of the linear distance A being greater than zero.

Figure 3B:
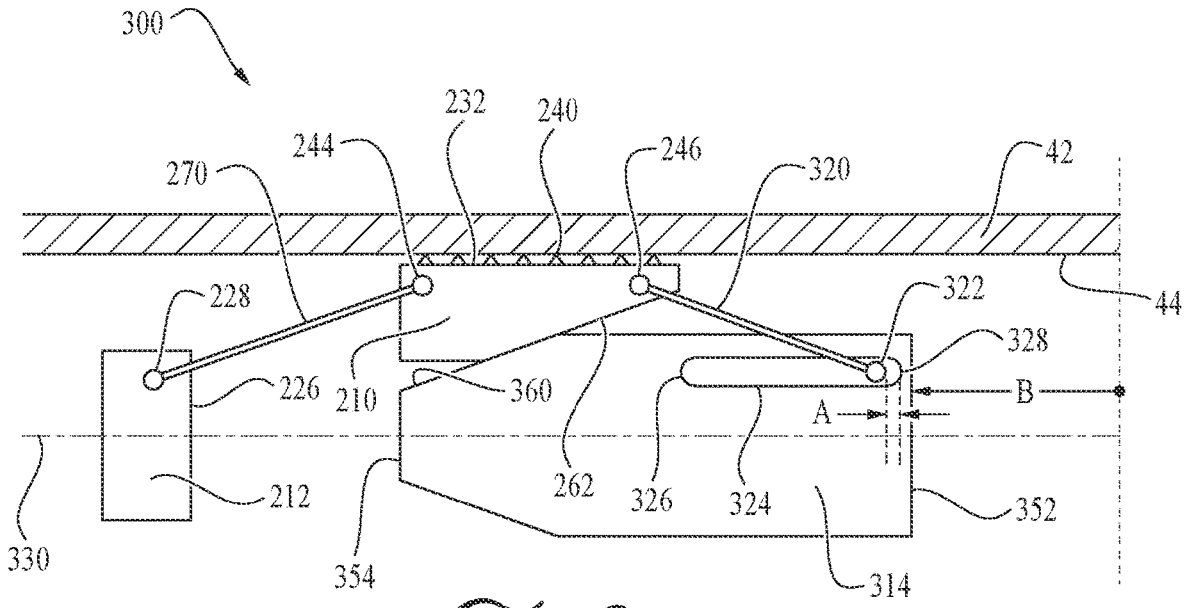
FIG. 3B is a side view of an anchoring mechanism of a downhole tool assembly set in a tubular according to another embodiment of the disclosure.

Turning now to FIG. 3B, the operation of the anchoring device 300 in small oilfield tubulars is described. In some embodiments, the anchoring device 300 of the downhole tool assembly 2 can be set in a small oilfield tubular, for example, a production tubing or a lower completion 30. For example, as previously disclosed the anchoring device 300 can be set or anchored to the inner surface 44 of a completion string 42. The wedge hub 314 can be urged towards the first hub 212 by an actuation mechanism coupled to the back face 352. The anchor pad 210 can extend outwards, e.g., away from the central axis 330, towards the inner surface 44 of the tubular 42 as the inner surface 262 slidingly contacts the tapered outer surface 360 of the wedge hub 314. The measurement of the linear distance A within the axle slot 324 can decrease in value as the inner surface 262 of the anchor pad 210 travels along the tapered outer surface 360 of the wedge hub 314. The outer surface 232 (and/or teeth 240) of the anchor pad 210 can grip or anchor to the inner surface 44 of the oilfield tubular 42. The actuation mechanism can urge the wedge hub 314 a linear distance labeled B until the outer surface 232/teeth 240 of the anchor pad 210 grips the inner surface 44.

In some embodiments, the anchor pad 210 grips the inner surface 44 of the tubular 42 before the distance A reaches zero, e.g., in the deactivation mode. For example, the outer surface 232 of the anchor pad 210 can grip the inner surface 44 of the tubular 42 when the translating axle 322 is 50% of the distance A within the axle slot 324. As previously described, it is understood that the translating axle 322 can travel 10%, 20%, 30%, 40%, 50%, 60%, 70%, 80%, 90%, or 100% of the distance A until the anchor pad 210 grips the tubular 42. As illustrated in FIG. 3B, the second arm 320 has traveled 100% of the distance A (thus, distance A is zero), for the outer surface 232 and/or teeth 240, to grip the inner surface 44 of the tubular 42.

Figure 3C:
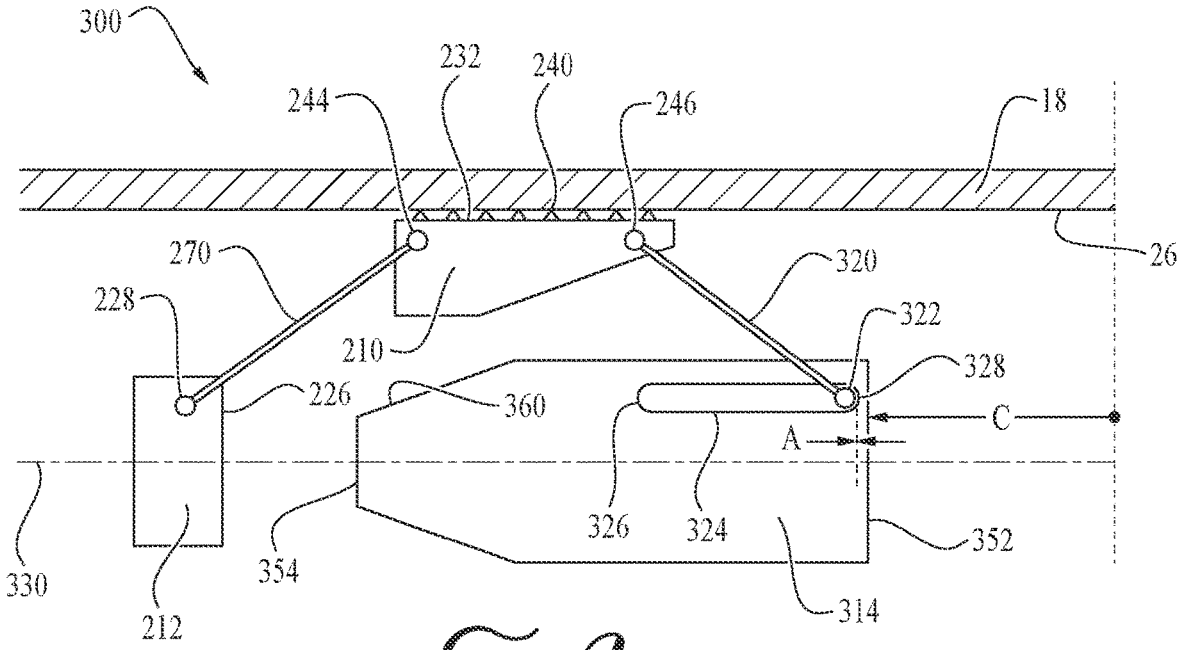
FIG. 3C is a side view of an anchoring mechanism of a downhole tool assembly set in another tubular according to another embodiment of the disclosure.

Turning now to FIG. 3C, the operation of the anchoring device 300 in large oilfield tubulars is described. In some embodiments, the anchoring device 300 of the downhole tool assembly 2 can be set in a large oilfield tubulars, for example, the casing string 18 shown in FIG. 1B. For example, as previously disclosed the anchoring device 300 can be set or anchored to the inner surface 26 of the casing string 18. The wedge hub 314 can be urged towards the first hub 212 by the actuation mechanism as the anchor pads 210 extend outwards, e.g., away from the central axis 330. The inner surface 262 of the anchor pads 210 can slidingly engage the tapered outer surface 360 of the wedge hub 314 until the linear distance A is zero and thus, the extension mechanism is in the activated mode. When the translating axle 322 contacts the second end 328 of the axle slot 324 and the linear distance A is zero, the second arm 320 can lift the anchor pad 210 towards the inner surface 26 of the oilfield tubular 18 and away from the central axis 330. The actuation mechanism can urge the wedge hub 314 a linear distance labeled C until the outer surface 232/teeth 240 of the anchor pad 210 grips the inner surface 26 of the oilfield tubular 18. The linear force of the actuating mechanism can be translated to a radial force exerted by the outer surface 232/teeth 240 of the anchor pad 210 by the first arm 270 coupled to the first hub 212 and the second arm 320 coupled to the wedge hub 314.

Although the anchoring device 300 is illustrated as a single set of an anchor pad 210, a first arm 270, and a second arm 320, it is understood that the anchoring device 300 can have 2 sets at 180 degrees, 3 sets at 120 degrees, 4 sets at 90 degrees, or any number of sets.

In some embodiments, the anchoring device 200 can return from the set position, e.g., the second position, to a run-in position, e.g., the first position. For example, referring to FIG. 2A-C, the actuation mechanism coupled to the wedge hub 214 can retract or urge the front face 254 away from the back face 226 of the first hub 212. The wedge hub 214 moving away from the first hub 212 can decrease the value of "C" as the pivot axle 266 transitions from a compression force to a tensile force to disengage the anchor pad 210 from the oilfield tubular 18. The anchor pad 210 can be lowered, e.g., moved towards the central axis 230, to the configuration shown in FIG. 2B wherein the inner surface 262 of the anchor pad 210 can contact or engage the tapered outer surface 260 of the wedge hub 214. In some embodiments, the value of the linear distance "C" can decrease to the value of the linear distance "B."

In some embodiments, the anchoring device 200 can return from a position wherein the anchor pad 210 is supported or in contact with the wedge hub 214 to the run-in position. The actuation mechanism can retract the wedge hub 214 to decrease the value of the linear distance "B" to a value of zero, e.g., the initial position or run-in position. The linear value of "A" within the telescoping arm 272 can increase as the linear value of "B" decreases as the anchor pad 210 is moved down the tapered outer surface 260 to the initial position as shown in FIG. 2A. In some embodiments, the actuation mechanism can generate a tensile force through the pivot axle 266, the telescopic arm 272, the anchor pad 210, the first arm 270, to the first hub 212 via the first pivot axle 228.

In some embodiments, the anchoring device 300 can return from the set position, e.g., the second position, to a run-in position, e.g., the first position. For example, referring to FIG. 3A-C, the actuation mechanism coupled to the wedge hub 314 can retract or urge the front face 354 away from the back face 226 of the first hub 212. The wedge hub 314 moving away from the first hub 212 can decrease the value of "C" as the axle 322 transitions from a compression force at the second end 328 to travel along the axle slot 324 to disengage the anchor pad 210 from the oilfield tubular 18. The anchor pad 210 can be lowered, e.g., moved towards the central axis 230, to the configuration shown in FIG. 3B wherein the inner surface 262 of the anchor pad 210 can contact or engage the tapered outer surface 360 of the wedge hub 314. In some embodiments, the value of the linear distance "C" can decrease to the value of the linear distance "B."

In some embodiments, the anchoring device 300 can return from a position wherein the anchor pad 210 is supported or in contact with the wedge hub 314 to the run-in position. The actuation mechanism can retract the wedge hub 314 to decrease the value of the linear distance "B" to a value of zero, e.g., the initial position or run-in position. The linear value of "A" within the axle slot 324 can increase as the linear value of "B" decreases as the anchor pad 210 is moved down the tapered outer surface 360 to the initial position as shown in FIG. 3A. In some embodiments, the actuation mechanism can generate a tensile force through the axle 322 in the first end 326, the second arm 320, the anchor pad 210, the first arm 270, to the first hub 212 via the first pivot axle 228.

The downhole tool assembly 2 can be anchored at a first target depth within the wellbore 8 to perform a service and moved to a second location within the wellbore to perform a service. In some embodiments, the downhole tool assembly 2 can be conveyed into a wellbore 8 to a target depth and anchored at that depth. For example, the downhole tool assembly 2 can be conveyed into the wellbore 8, via a workstring 6, to a first target depth, e.g., a casing string location 28, a controller 10 within the logging facility 4 can activate the anchoring device 34, and the downhole tool assembly 2 can be anchored by the anchoring device 34. The anchoring device 34 can extend the anchor pad 210 to a set position as illustrated in FIG. 2C or FIG. 3C when the anchoring device is within a casing string location 28. The service tool 36 of the downhole tool assembly 2 can perform a service operation within the wellbore, for example, measure periodic datasets of the downhole environment. The controller 10 can release the downhole tool assembly 2 by retracting the anchoring device 34 to a first position or run-in position as shown in FIG. 2A or FIG. 3A. The logging facility 4 can convey the downhole tool assembly 2 to a second target location within the wellbore 8 via the workstring 6. The second target location can be within a lower completion 30 or a production tubing. The controller 10 within the logging facility 4 can activate the anchoring device 34 via an actuation mechanism to extend the anchor pad 210 to a set position as illustrated in FIG. 2B or FIG. 3B with the anchoring device 34 within a lower completion 30. The service tool 36 of the downhole tool assembly 2 can perform a service operation within the wellbore, for example, measure periodic datasets of the downhole environment. The controller 10 can release the downhole tool assembly 2 by retracting the anchoring device 34 to a first position or run-in position as shown in FIG. 2A or FIG. 2B. The logging facility 4 can convey the downhole tool assembly 2 to a third target location within the wellbore 8 or retrieve the downhole tool assembly 2 out of the wellbore 8, e.g., to the surface.

ADDITIONAL DISCLOSURE

The following are non-limiting, specific embodiments in accordance with the present disclosure:

A first embodiment, which is a downhole anchoring device, comprising a first hub with a generally cylinder shape with an outer surface and an axial centerline coincident with a longitudinal center line of the downhole anchoring device; a first arm rotationally coupled to a first axle of the first hub and a first pivot point of an anchor pad; a wedge bub with a generally cylinder shape with an outer surface, a tapered surface, and an axle with an axial centerline coincident with the longitudinal center line of the downhole anchoring device; an extension mechanism comprising a deactivated mode and an activated mode rotationally coupled to a pivot axle of the wedge hub and a second pivot point of the anchor pad, and wherein the extension mechanism is configured in an activated mode in response to a compression loading; wherein the anchor pad is configured to be extended radially outwards by the tapered surface of the wedge hub to engage an inner surface of a small oilfield tubular in response to an extend-retract mechanism urging the wedge hub towards the first hub and the extension mechanism configured in a deactivated mode; and wherein the anchor pad is configured to be extended radially outwards by the first arm and the extension mechanism to engage the inner surface of a large oilfield tubular in response to the extend-retract mechanism urging the wedge hub towards the first hub and the extension mechanism configured in an activated mode.

A second embodiment, which is the downhole anchoring device of the first embodiment, wherein the inner surface of the anchor pad is in contact with a tapered outer surface to extend the anchor pad radially outward to contact the inner surface of the small oilfield tubular with the extension mechanism in the deactivated mode.

A third embodiment, which is the downhole anchoring device of the second embodiment, wherein the anchor pad is extended radially outwards towards the inner surface of the large oilfield tubular by the first pivot point via the first arm and the second pivot point via the extension mechanism in response to the extension mechanism in the activated mode.

A fourth embodiment, which is the downhole anchoring device of any of the first through the third embodiments, wherein the extension mechanism is a telescopic arm assembly or a sliding axle assembly.

A fifth embodiment, which is the downhole anchoring device of the fourth embodiment, wherein the telescopic arm assembly comprises an extension arm slidably engaged with an arm housing, and wherein the telescopic arm assembly is activated by a front face of the extension arm contacting a back face of the arm housing.

A sixth embodiment, which is the downhole anchoring device of any of the first through the fifth embodiments, wherein the sliding axle assembly comprises a pivot axle movably positioned within an axle slot located on the wedge hub, and wherein the sliding axle assembly is activated by the pivot axle contacting a second end face of the axle slot.

A seventh embodiment, which is the downhole anchoring device of any of the first through the sixth embodiments, wherein the downhole anchoring device is configured to anchor a downhole tool assembly in a target location.

An eighth embodiment, which is the downhole anchoring device of any of the first through the seventh embodiments, wherein the anchor pad is configured to grip the inner surface of the oilfield tubular with an outer surface, a plurality of teeth, or combinations thereof.

A ninth embodiment, which is the downhole anchoring device of any of the first through the eighth embodiments, wherein the extend-retract mechanism is one of i) a hydraulic system with a volume of fluid and a pump, ii) a motor-driving a gear system, or iii) a motor turning a threaded extension.

A tenth embodiment, which is the downhole anchoring device of any of the first through the ninth embodiments, further comprising a controller communicatively coupled to the extend-retract mechanism; and wherein the controller is configured to extend the extend-retract mechanism, retract the extend-retract mechanism, or maintain a position of the extend-retract mechanism.

An eleventh embodiment, which is a method of operating an anchoring mechanism within a wellbore penetrating a formation, comprising conveying the anchoring mechanism into the wellbore on a workstring, wherein the anchoring mechanism comprises a first hub, an anchor pad, a wedge hub, and an extension mechanism; radially moving the anchor pad towards an inner surface of a tubular by urging the wedge hub from a first position towards the first hub by an extend-retract mechanism; anchoring the anchoring mechanism at a first target location by griping the inner surface of the tubular with an outer surface of the anchor pad with the extension mechanism in a deactivated mode or an activated mode; and operating a service tool to perform a wellbore service in response to anchoring the service tool via the anchoring mechanism at the first target location.

A twelfth embodiment, which is the method of the eleventh embodiment, further comprising releasing the anchoring mechanism from the first target location, wherein releasing the anchoring mechanism comprises moving, by the extend-retract mechanism, the wedge hub away from the first hub, and wherein the wedge hub is moved from a set position to the first position; conveying the anchoring mechanism via the workstring to a second target location within the wellbore; and anchoring the anchoring mechanism, by the extend-retract mechanism, at the second target location by moving the wedge hub from the first position towards the first hub, wherein the extension mechanism is configured in an activated mode or a deactivated mode, and wherein the configuration of the extension mechanism in the second target location is different from the configuration of the extension mechanism in the first target location.

A thirteenth embodiment, which is the method of any of the eleventh and the twelfth embodiments, wherein an inner surface of the anchor pad is in contact with a tapered outer surface of the wedge hub in response to the extension mechanism being in the deactivated mode; and wherein the anchor pad is expanded outwards by a first arm and the extension mechanism in response to the extension mechanism being in the activated mode.

A fourteenth embodiment, which is the method of any of the eleventh through the thirteenth embodiments, wherein the extend-retract mechanism comprises an electric motor electrically coupled to a power source at surface via the workstring.

A fifteenth embodiment, which is the method of any of the eleventh through the fourteenth embodiments, wherein the anchoring mechanism is part of a downhole tool assembly.

A sixteenth embodiment, which is a system of a downhole tool assembly, comprising a surface logging facility; an anchoring mechanism coupled to the surface logging facility by a workstring; a service tool coupled to the anchoring mechanism; an electric motor within an extend-retract mechanism coupled to the anchor mechanism; at least one sensor providing periodic datasets of the anchoring mechanism, the extend-retract mechanism, or both; a controller comprising a processor and a non-transitory memory communicatively coupled to the workstring, configured to: extend an anchoring pad of the anchoring mechanism by moving a wedge hub from a run-in position towards a first hub, wherein the anchor pad is radially extended by an inner surface of the anchor pad in contact with a tapered outer surface of the wedge hub with the extension mechanism in a first configuration, and wherein the anchor pad is radially extended by a first arm and the extension mechanism in response to the extension mechanism in a second configuration; anchor the anchoring mechanism at a first target location by gripping the inner surface of a wellbore tubular with an outer surface of the anchor pad; wherein an extension mechanism is in a first configuration in a small wellbore tubular or the extension mechanism is in a second configuration in a large wellbore tubular; and operate the service tool at the first target location to perform a wellbore service.

A seventeenth embodiment, which is the system of the sixteenth embodiment, further comprising release the anchoring mechanism from the first target location by returning the anchoring pad to the run-in position by the extend-retract mechanism.

An eighteenth embodiment, which is the system of the seventeenth embodiment, wherein the at least one sensor is a positioning sensor, a stress/strain sensor, or both.

A nineteenth embodiment, which is the system of the seventeenth embodiment, wherein the extension mechanism is loaded with compressive force in the second configuration.

A twentieth embodiment, which is the system of any of the sixteenth through the nineteenth embodiments, wherein the service tool comprises a perforating gun assembly, a shifting tool assembly, a packer assembly, a bridge plug assembly, a downhole pump assembly, or combinations thereof.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RJ, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A downhole anchoring device, comprising:

a first hub comprising a generally cylindrical shape, an outer surface, and an axial centerline coincident with a longitudinal center line of the downhole anchoring device;

a first arm rotationally coupled to a first axle of the first hub and a first pivot point of an anchor pad;

a wedge hub comprising a generally cylindrical shape, an outer surface, a tapered surface, a pivot axle, and an axial centerline coincident with the longitudinal center line of the downhole anchoring device; and an extension mechanism comprising a deactivated mode and an activated mode, wherein the extension mechanism is rotationally coupled to the pivot axle of the wedge hub and a second pivot point of the anchor pad, wherein the anchor pad is configured to be extended radially outwards by sliding against the tapered surface of the wedge hub to engage an inner surface of a small oilfield tubular, in response to an extend-retract mechanism urging the wedge hub towards the first hub and the extension mechanism being in the deactivated mode, and wherein the anchor pad is configured to be extended radially outwards, by pivoting of the first arm and the extension mechanism, to engage an inner surface of a large oilfield tubular, in response to the extend-retract mechanism urging the wedge hub towards the first hub and the extension mechanism being in the activated mode.

2. The downhole anchoring device of claim 1, wherein:

an inner surface of the anchor pad is configured to slide against the tapered surface of the wedge hub to extend the anchor pad radially outward to contact the inner surface of the small oilfield tubular when the extension mechanism is in the deactivated mode.

3. The downhole anchoring device of claim 1, wherein:

the anchor pad is configured to be extended radially outwards towards the inner surface of the large oilfield tubular by moving away from the wedge hub when the extension mechanism is in the activated mode.

4. The downhole anchoring device of claim 1, wherein the extension mechanism comprises a telescopic arm assembly or a sliding axle assembly.

5. The downhole anchoring device of claim 4, wherein the telescopic arm assembly comprises an extension arm slidably engaged with an arm housing, and wherein the telescopic arm assembly is configured to be activated by a front face of the extension arm contacting a back face of the arm housing.

6. The downhole anchoring device of claim 4, wherein the pivot axle is movably positioned within an axle slot located on the wedge hub, and wherein the sliding axle assembly is configured to be activated by the pivot axle contacting an end face of the axle slot.

7. The downhole anchoring device of claim 1, wherein the downhole anchoring device is configured to anchor a downhole tool assembly at a target location.

8. The downhole anchoring device of claim 7, wherein the anchor pad is further configured to grip the inner surface of the small oilfield tubular using a plurality of teeth.

9. The downhole anchoring device of claim 1, wherein the extend-retract mechanism comprises a hydraulic system, a motor-driven gear system, or motor-driven threaded extension.

10. The downhole anchoring device of claim 1, further comprising:

a controller communicatively coupled to the extend-retract mechanism, wherein the controller is configured to control the extend-retract mechanism to extend, retract, or maintain a position.

11. The downhole anchoring device of claim 1, wherein the extension mechanism is configured to be in the activated mode in response to a compression loading.

12. The downhole anchoring device of claim 1, wherein the extension mechanism is configured to be in compression when in the activated mode.

13. The downhole anchoring device of claim 1, wherein the anchor pad is configured to be spaced apart from the wedge hub when the extension mechanism is in the activated mode.

14. A method of operating an anchoring mechanism within a wellbore, comprising:

conveying the anchoring mechanism into the wellbore on a workstring, wherein the anchoring mechanism comprises a first hub, an anchor pad, a wedge hub, and an extension mechanism comprising a deactivated mode and an activated mode, and wherein the extension mechanism is rotationally coupled to a pivot axle of the wedge hub and a pivot point of the anchor pad;

radially moving the anchor pad towards an inner surface of a tubular in the wellbore by urging the wedge hub towards the first hub;

anchoring the anchoring mechanism at a first target location by an outer surface of the anchor pad gripping the inner surface of the tubular;

anchoring a service tool via the anchoring mechanism at the first target location; and operating the service tool to perform a wellbore service.

15. The method of claim 14, further comprising:

releasing the anchoring mechanism from the first target location, wherein the releasing of the anchoring mechanism comprises moving, by an extend-retract mechanism, the wedge hub away from the first hub, and wherein the wedge hub is moved from a set position to a first position;

conveying the anchoring mechanism via the workstring to a second target location within the wellbore; and anchoring the anchoring mechanism, by the extend-retract mechanism, at the second target location by moving the wedge hub from the first position towards the first hub, wherein a configuration of the extension mechanism in the second target location is different from a configuration of the extension mechanism in the first target location.

16. The method of claim 14, wherein:

an inner surface of the anchor pad contacts a tapered outer surface of the wedge hub when the extension mechanism is in the deactivated mode; and the anchor pad is pushed outwards by a first arm and the extension mechanism to when the extension mechanism is in the activated mode.

17. The method of claim 14, wherein:

the wedge hub is urged towards the first hub by an extend-retract mechanism, and the extend-retract mechanism comprises an electric motor electrically coupled to a power source at surface via the workstring.

18. The method of claim 14, wherein the anchoring mechanism is part of a downhole tool assembly.

19. The method of claim 14, wherein the anchor pad is spaced apart from the wedge hub when the extension mechanism is in the activated mode.

20. A system for performing a wellbore service, comprising:

a surface logging facility;

an anchoring mechanism comprising a first hub, an anchor pad, a wedge hub, and an extension mechanism comprising a deactivated mode and an activated mode, wherein the extension mechanism is rotationally coupled to a pivot axle of the wedge hub and a pivot point of the anchor pad, and wherein the anchoring mechanism is coupled to the surface logging facility by a workstring;

a service tool coupled to the anchoring mechanism;

an electric motor coupled to the anchoring mechanism; and a controller configured to control the electric motor to drive the wedge hub towards the first hub to cause an inner surface of the anchor pad to slide against a tapered outer surface of the wedge hub to move the anchor pad radially outward towards an inner surface of a wellbore tubular when the extension mechanism is in the deactivated mode, wherein the anchoring mechanism is configured to be anchored at a first target location by an outer surface of the anchor pad gripping the inner surface of the wellbore tubular, and wherein the service tool is configured to operate at the first target location to perform a wellbore service.

21. The system of claim 20, wherein:

the anchoring mechanism is configured to be released from the first target location by returning the anchoring pad to a run-in position by an extend-retract mechanism coupled to the electric motor.

22. The system of claim 20, further comprising at least one sensor configured to provide periodic datasets of the anchoring mechanism to the controller, wherein the at least one sensor comprises either one or both of a positioning sensor or a stress/strain sensor.

23. The system of claim 20, wherein the extension mechanism is configured to be loaded with compressive force when in the activated mode.

24. The system of claim 20, wherein the service tool comprises a perforating gun assembly, a shifting tool assembly, a packer assembly, a bridge plug assembly, a downhole pump assembly, or combinations thereof.

25. The system of claim 20, wherein the anchor pad is configured to be spaced apart from the wedge hub when the extension mechanism is in the activated mode.

* * * * *